US007128827B2

(12) United States Patent
Tallman et al.

(10) Patent No.: US 7,128,827 B2
(45) Date of Patent: Oct. 31, 2006

(54) INTEGRATED CATALYTIC CRACKING AND STEAM PYROLYSIS PROCESS FOR OLEFINS

(75) Inventors: Michael J. Tallman, Houston, TX (US); Chris Santner, Houston, TX (US); Richard B. Miller, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 337 days.

(21) Appl. No.: 10/707,817

(22) Filed: Jan. 14, 2004

(65) Prior Publication Data

US 2005/0150817 A1 Jul. 14, 2005

(51) Int. Cl.
*C10G 53/16* (2006.01)
*C07C 4/04* (2006.01)
*C07C 4/06* (2006.01)

(52) U.S. Cl. ..... 208/78; 585/302; 585/304

(58) Field of Classification Search ..... 208/78; 585/302, 304

See application file for complete search history.

(56) References Cited

U.S. PATENT DOCUMENTS

| | | | | |
|---|---|---|---|---|
| 3,274,978 | A | 9/1966 | Palchik et al. | 122/356 |
| 3,407,789 | A | 10/1968 | Hallee et al. | 122/356 |
| 3,647,682 | A | 3/1972 | Rabo et al. | 208/120 |
| 3,758,403 | A | 9/1973 | Rosinski et al. | 502/67 |
| 3,785,782 | A | 1/1974 | Cartmell | 422/144 |
| 3,820,955 | A | 6/1974 | Woebcke et al. | 422/197 |
| 3,910,347 | A | 10/1975 | Woebcke et al. | 165/142 |
| 4,215,231 | A | 7/1980 | Raymond | 585/251 |
| 4,404,095 | A | 9/1983 | Haddad et al. | 208/161 |
| 4,419,221 | A | 12/1983 | Castagnos, Jr. et al. | 208/113 |
| 4,499,055 | A | 2/1985 | DiNicolantonio et al. | 422/197 |
| 4,762,958 | A | 8/1988 | Martens et al. | 585/613 |
| 4,814,067 | A | 3/1989 | Gartside et al. | 208/127 |
| 4,828,679 | A | 5/1989 | Cormier, Jr. et al. | 208/120 |
| 4,980,053 | A | 12/1990 | Li et al. | 207/120 |
| 5,026,935 | A | 6/1991 | Leyshon et al. | 585/315 |
| 5,026,936 | A | 6/1991 | Leyshon et al. | 585/315 |
| RE33,728 | E | 10/1991 | Dean et al. | 208/120 |
| 5,151,158 | A | 9/1992 | Bowen et al. | 196/110 |
| 5,326,465 | A | 7/1994 | Yonngging et al. | 208/120 |
| 5,523,502 | A | 6/1996 | Rubin | 585/324 |
| 5,932,777 | A | 8/1999 | Sughrue, II et al. | 585/322 |
| 5,981,818 | A | 11/1999 | Purvis et al. | 585/519 |
| 6,033,555 | A | 3/2000 | Chen et al. | 208/52 |
| 6,149,800 | A | 11/2000 | Iaccino et al. | 208/61 |
| 6,156,947 | A | 12/2000 | Vora | 585/324 |
| 6,410,813 | B1 | 6/2002 | Dath et al. | 585/653 |
| 6,417,421 | B1 | 7/2002 | Yao | 585/418 |

*Primary Examiner*—Thuan D. Dang
(74) *Attorney, Agent, or Firm*—Lundeen & Dickenson, LLP; Bradley A. Misley

(57) ABSTRACT

Integration of gas oil and light olefin catalytic cracking zones with a pyrolytic cracking zone to maximize efficient production of petrochemicals is disclosed. Integration of the units in parallel allows production of an overall product stream with maximum ethylene and/or propylene by routing various feedstreams and recycle streams to the appropriate cracking zone(s), e.g. ethane/propane to the steam pyrolysis zone and $C_4$ $C_6$ olefins to the light olefin cracking zone. This integration enhances the value of the material balances produced by the integrated units.

9 Claims, 4 Drawing Sheets

INTEGRATED CATALYTIC CRACKING AND STEAM PYROLYSIS PROCESS FOR OLEFINS

BACKGROUND OF INVENTION

This disclosure relates to the integration of catalytic and pyrolytic cracking units to produce olefins from a variety of feedstreams.

Olefins have long been desired as products from the petrochemical industry. Olefins such as ethylene, propylene, butenes, and pentenes are useful for preparing a wide variety of end products, including polyethylenes, polypropylenes, polyisobutylene and other polymers, alcohols, vinyl chloride monomer, acrylonitrile, methyl tertiary butyl ether and tertiary amyl methyl ether and other petrochemicals, and a variety of rubbers such as butyl rubber. A large number of processes, described in the literature, are directed to the production of olefins. In recent years, there has been an increasing demand for light olefinic gases while supplies of suitable feedstocks for producing such olefins have declined. Thus, the petrochemical industry is continuously looking for processes capable of providing improved flexibility in producing various olefins from hydrocarbon feedstocks.

This is especially true for the production of propylene. The largest source of petrochemical propylene on a worldwide basis is that produced as the primary byproduct of ethylene manufacture by thermal cracking. Ethylene plants charging liquid feedstocks typically produce about 10 to 20 weight percent propylene and provide about 70 percent of the propylene consumed by the petrochemical industry. Petroleum refining, predominantly from fluidized catalytic cracking ("FCC"), is by far the next largest supplier of worldwide propylene production, supplying about 30 percent of the petrochemical requirement. In the U.S., FCC's supply about one-half of the petrochemical propylene demand.

The demand for propylene is expected to more than double, primarily driven by the rapidly increasing market for polypropylene. Propylene demand by the petrochemical industry is projected to increase more rapidly than the demand for ethylene. Since ethylene plants produce more ethylene than propylene, and since many of the new ethylene plants in construction are based on ethane feed with no propylene co-produced, significant increases in propylene from FCC will be required to meet the increased demand.

U.S. Pat. No. 5,026,936 teaches a process for the preparation of propylene from $C_4$ or higher feeds by a combination of cracking and metathesis wherein the higher hydrocarbon is cracked to form ethylene and propylene and at least a portion of the ethylene is metathesized to propylene. See also U.S. Pat. No. 5,026,935.

Processes for non-catalytically cracking and catalytically cracking hydrocarbon feedstocks are well known. Steam cracking in a furnace and contact with hot non-catalytic particulate solids are two well-known non-catalytic cracking processes. Exemplary processes are described in U.S. Pat. Nos. 3,407,789; 3,820,955; 4,499,055; and 4,814,067. Fluid catalytic cracking and deep catalytic cracking are two well-known catalytic cracking processes. U.S. Pat. Nos. 4,828,679; 3,647,682; 3,758,403; 4,814,067; 4,980,053; and 5,326,465 disclose exemplary processes.

There has been little activity to integrate catalytic and pyrolytic cracking processes with each other. U.S. Pat. No. 5,523,502 discloses a process design for olefin production incorporating an integrated deep catalytic cracking unit and a thermal cracking unit. Deep catalytic cracking is a process in which a preheated hydrocarbon feedstock is cracked over a heated solid acidic catalyst in a reactor at temperatures ranging from about 925° F. to about 1350° F. U.S. Pat. No. 6,033,555 discloses a process involving catalytic cracking of a hydrocarbon feedstock followed by thermal cracking.

SUMMARY OF INVENTION

This disclosure relates to a process that integrates catalytic and pyrolytic/thermal cracking units to maximize efficient production of petrochemicals. Integration of the units allows production of an overall product stream with maximum value by routing various feedstreams and byproduct streams to the appropriate cracking technology. This integration enhances the value of the material balances produced by the integrated units even while using the lowest value feedstreams.

An embodiment of the present invention provides an olefin process that includes: (a) passing a light alkane stream comprising ethane, propane or a combination thereof through a steam pyrolysis zone and quenching effluent therefrom to form a pyrolysis effluent enriched in ethylene, propylene or a combination thereof; (b) cracking a light hydrocarbon stream comprising olefins having at least 4 carbon atoms in a first FCC zone to form a first FCC effluent enriched in ethylene, propylene or a combination thereof; (c) cracking a refinery stream comprising gas oil, full range gas oil, resid, or a combination thereof in a second FCC zone to form a second FCC effluent enriched in ethylene, propylene or a combination thereof; (d) fractionating the first and second FCC effluents together to remove heavy naphtha, light cycle oil, slurry oil, or a combination thereof and recover a combined olefin-containing FCC fraction; (e) conditioning the pyrolysis effluent together with the combined FCC fraction to remove oxygenates, acid gases, water or a combination thereof to form a conditioned stream; (f) separating the conditioned stream into at least a tail gas stream, an ethylene product stream, a propylene product stream, a light hydrocarbon stream comprising ethane, propane, or a combination thereof, an intermediate stream comprising olefin selected from $C_4$ to $C_6$ olefins and mixtures thereof, and a heavy stream comprising $C_7$ and higher hydrocarbons; (g) recycling the light hydrocarbon stream to the steam pyrolysis zone; and (h) recycling the intermediate stream to the first FCC zone.

The heavy stream can be recycled to the first FCC zone. Depending on feedstock availability, the light alkane stream passed through the steam pyrolysis zone can also include naphtha or liquefied petroleum gas (LPG). Similarly, the light hydrocarbon stream cracked in the first FCC zone can include naphtha, preferably FCC naphtha, more preferably light cat naphtha. The refinery stream cracked in the second FCC zone is preferably a waxy gas oil.

In another embodiment, the process includes hydrotreating the heavy stream to obtain a hydrotreated stream, extracting a product stream comprising benzene, toluene, xylenes or a mixture thereof from the hydrotreated stream to obtain a raffinate stream lean in aromatics, and recycling the raffinate stream to the steam pyrolysis zone.

In another embodiment, the present invention provides an olefin process unit with parallel steam pyrolysis, light olefin FCC and gas oil-resid FCC zones for producing a combined effluent enriched in ethylene and propylene. The process unit also includes means for conditioning the combined effluent to remove oxygenates, acid gases and water to form a conditioned stream, and means for separating the conditioned stream into at least a tail gas stream, an ethylene product stream, a propylene product stream, a light stream comprising ethane, propane, or a combination thereof, an intermediate stream comprising $C_4$ to $C_6$ olefins, and a heavy stream comprising $C_7$ and higher hydrocarbons. Means are provided for recycling the light stream to the steam pyrolysis zone and the intermediate stream to the first FCC zone.

DETAILED DESCRIPTION

Figure 1:
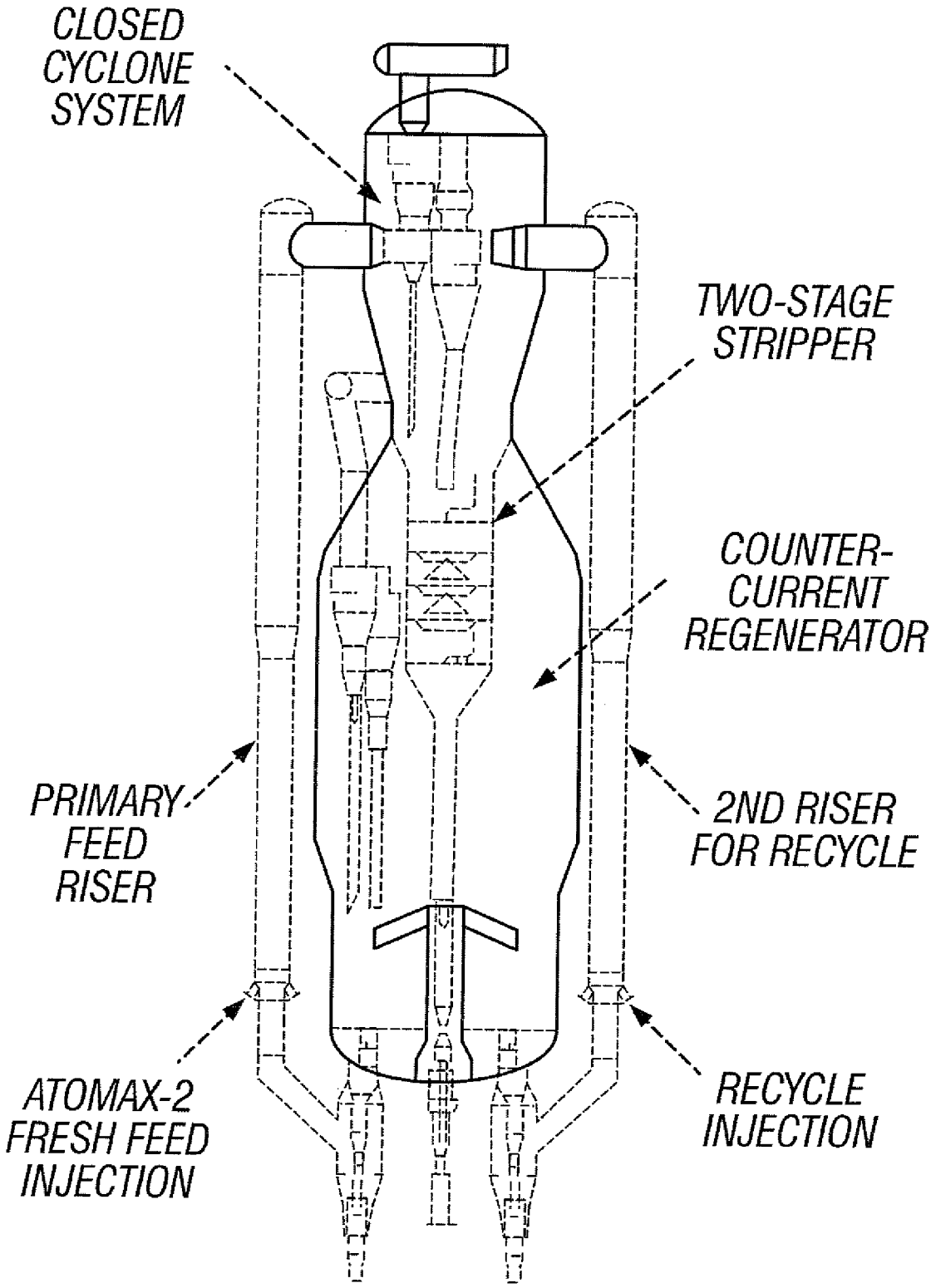
FIG. 1 is a schematic representation of a dual riser cracking reactor.

This disclosure details the flexible production of olefins and other petrochemical feedstocks by the parallel integration of two different FCC reaction zones with a steam pyrolysis reaction zone. These reaction zones are integrated with effluent separation and conditioning, olefin recovery, and hydrocarbon recycle to the reaction zones. The process can preferably include benzene, toluene, xylenes (BTX) production and raffinate recycle to the steam pyrolysis reaction zone.

Various cracking technologies that produce petrochemicals, including steam pyrolysis technology and FCC technologies of various types can be used in an integrated fashion to enhance product yields, particularly propylene and ethylene. The integration allows petrochemical complexes to be operated using a variety of low value feedstreams. The integration allows production of an overall product stream with maximum value by routing of various by-products to the optimum cracking technology. For example, fresh feedstock can be routed to either FCC or steam pyrolysis type reactors. $C_4$'s, $C_5$'s and/or BTX raffinate are recycled to either a separate light hydrocarbon FCC-type reactor or to a second riser on the FCC reactor to convert these streams to propylene and ethylene. Saturated byproduct streams such as ethane, propane and/or BTX raffinate are recycled to pyrolysis to maximize ethylene production.

Integrating the thermal cracking with different types of catalytic cracking processes as described herein provides a surprisingly improved degree of olefin product selectivity. The steam cracking is effective in utilizing $C_2$–$C_4$ paraffin-containing feedstocks and emphasizes the production of ethylene and propylene, while the catalytic cracking processes provide significant propylene and higher olefin yields.

Steam pyrolysis or cracking processes are well known to those of ordinary skill in the art. Steam cracking processes are generally carried out in radiant furnace reactors at elevated temperatures for short residence times while maintaining a low reactant partial pressure, relatively high mass velocity, and effecting a low pressure drop through the reaction zone. Any of the known furnaces may be used in accordance with this disclosure. Exemplary steam cracking processes are disclosed in U.S. Pat. Nos. 5,151,158; 3,274,978; 3,407,789; 3,820,955; 4,780,196; 4,499,055; and 4,762,958.

Optionally, the recycle feedstocks to the steam cracking unit may be supplemented with a variety of other relatively light hydrocarbon feedstocks such as ethane, propane, butane, naphthas, condensates, gas oils, mixtures thereof, or the like. The hydrocarbon feed to the steam cracker can be in the liquid or vapor phase or may comprise a mixed liquid-vapor phase. The hydrocarbon is normally in the vapor phase in the reaction zone. The feed will generally be preheated in a preheat zone from about ambient temperature to an intermediate temperature. The preheated feed is then introduced into a convection zone of a pyrolysis furnace to further preheat the feed to a temperature below that at which significant reaction takes place, e.g., 560° C. to 705° C. In one of the preheating steps, the feed is vaporized and superheated. Steam is generally added to the feed at some point prior to the radiant reaction zone of the pyrolysis furnace. The steam functions to maintain low hydrocarbon partial pressure and reduce coking in the radiant reaction zone. The feed is cracked at very high temperatures, e.g., from 810° C. up to about 930° C., in the radiant reaction zone. The feed rate is such that the velocity through the radiant coils ranges from about 90 to about 245 m/s based on the total flow of steam and hydrocarbon. Steam is typically employed in amounts to provide a steam to feed weight ratio ranging from about 0.07 to about 2.0. The residence time of the feed in the radiant section of the cracking coil generally ranges from about 0.1 to about 1 second.

To prevent production of large amounts of undesirable by-products and to prevent severe coking, it is desirable to rapidly cool the effluent product gases issuing from the radiant zone from an exit temperature of from about 810° C. to about 930° C. to a temperature at which the cracking reactions substantially stop. This can be accomplished by rapidly cooling the effluent, such as in a suitable heat exchange apparatus or by direct quenching, to from about 175° C. to about 650° C. The cooling step is preferably carried out very rapidly after the effluent leaves the radiant section of the furnace, i.e., about 1 to 40 milliseconds. See U.S. Pat. Nos. 3,407,789 and 3,910,347, for example.

In catalytic cracking, catalyst particles are heated and introduced into a fluidized cracking zone with a hydrocarbon feed. The cracking zone temperature is typically maintained at from about 425° C. to about 705° C. Any of the known catalysts useful in fluidized catalytic cracking may be employed in the practice of the present invention, including but not limited to Y-type zeolites, USY, REY, REUSY, faujasite and other synthetic and naturally occurring zeolites and mixtures thereof. Exemplary FCC processes are disclosed in U.S. Pat. Nos. 4,814,067; 4,404,095; 3,785,782; 4,419,221; 4,828,679; 3,647,682; 3,758,403; and RE 33,728.

One of the fluid catalytic cracking processes in the present invention processes a feedstock, which is a refinery stream boiling in a temperature range of from about 650° C. to about 705° C. In another embodiment, the feedstock is a refinery stream boiling in a range from about 220° C. to about 645° C. In a third embodiment, the refinery stream boils from about 285° C. to about 645° C. at atmospheric pressure. The hydrocarbon fraction boiling at a temperature ranging from about 285° C. to about 645° C. is generally referred to as a gas oil boiling range component while the hydrocarbon fraction boiling at a temperature ranging from about 220° C. to about 645° C. is generally referred to as a full range gas oil/resid fraction or a long resid fraction.

Hydrocarbon fractions boiling at a temperature of below about 220° C. are generally more profitably recovered as gasoline. Hydrocarbon fractions boiling at a temperature ranging from about 220° C. to about 355° C. are generally more profitably directed to distillate and diesel fuel product pools, but can be, depending on refinery economics, directed to a fluid catalytic cracking process for further upgrading to gasoline.

Hydrocarbon fractions boiling at a temperature of greater than about 535° C. are generally regarded as residual fractions. Such residual fractions commonly contain higher proportions of components that tend to form coke in the fluid catalytic cracking process. Residual fractions also generally contain higher concentrations of undesirable metals such as nickel and vanadium, which further catalyze the formation of coke. While upgrading residual components to higher value, lower boiling hydrocarbons is often profitable for the refiner, the deleterious effects of higher coke production, such as higher regenerator temperatures, lower catalyst to oil ratios, accelerated catalyst deactivation, lower conversions, and increased use of costly flushing or equilibrium catalyst for metals control must be weighed against these benefits.

Typical gas oil and long resid fractions are generally derived from any one or more of several refinery process sources including but not limited to a low, medium, or high sulfur crude unit atmospheric and/or vacuum distilation tower, a delayed or fluidized coking process, a catalytic hydrocracking process, and/or a distillate, gas oil, or resid hydrotreating process. Moreover, fluid catalytic cracking feedstocks can be derived as by-products from any one of several lubricating oil manufacturing facilities including, but not limited to a lubricating oil viscosity fractionation unit, solvent extraction process, solvent dewaxing process, or hydrotreating process. Moreover, fluid catalytic cracking feedstocks can also be derived through recycle of various product streams produced at a fluid catalytic cracking process. Recycle streams such as decanted oil, heavy catalytic cycle oil, and light catalytic cycle oil may be recycled directly or may pass through other processes such as a hydrotreating process prior to the fluid catalytic cracking process.

The catalytic cracking processes described herein generally include a reaction step wherein a catalyst is contacted directly with a feedstock and a catalytically cracked product is formed, a separation step wherein the catalyst is separated from the catalytically cracked product, a stripping step wherein a substantial amount of the hydrocarbon that remains with the separated coked catalyst is removed, and a regeneration step wherein coke is combusted for catalyst reuse in the reaction step.

A detailed process description of a fluid catalytic cracking process in accordance with the present invention generally begins with a feedstock preheating step. The feedstock is generally preheated from waste heat provided from downstream process fractionation steps including, but not limited to, the main fractionator pumparound systems. These main fractionator waste heat pumparound systems circulate fractionator streams comprising any or all of cracked gasoline, light catalytic cycle oil, heavy catalytic cycle oil, and decanted oil or slurry to facilitate the removal of heat from critical sections of the fractionator. The feedstock preheat temperature prior to reaction generally ranges from about 90° C. to about 370° C.

The preheated feedstock is contacted with a regenerated fluidized catalytic cracking catalyst provided at a temperature generally ranging from about 425° C. to about 815° C., and immediately and substantially vaporized and reacted through and within a riser reactor or fluidized bed reactor. The mixture of catalytic cracking catalyst and catalytically cracked hydrocarbon generally exit the riser reactor at a reaction temperature ranging from about 450° C. to about 680° C. in one embodiment. In another embodiment, the exit temperature is from about 425° C. to about 645° C., and more preferably from about 480° C. to about 595° C. The pressure of most modern fluid catalytic cracking processes generally ranges from about 68 kPa to about 690 kPa. Typical catalyst to oil ratios, measured in weight of catalyst to weight of oil, generally range from about 2:1 to about 20:1 in one embodiment. In another embodiment, the ratio ranges from about 4:1 to about 14:1. In a third embodiment, the ratio ranges from about 5:1 to about 10:1 for best results.

The process described herein also includes at least one fluidized catalytic cracking zone, other than a conventional FCC unit, for a light hydrocarbon feedstock. Such catalytic cracking units may be of the type designed to enhance propylene yields from FCC feedstocks. One such non-conventional catalytic cracking unit, increasing propylene yields by combining the effects of additive formulations containing high levels of ZSM-5 and dual riser hardware technology, includes, in addition to a first conventionally operated riser, a second high severity riser designed to crack surplus naphtha or other light hydrocarbon streams into light olefins. This technology is available by license from Kellogg Brown & Root under the designation MAXOFIN.

FCC naphtha, preferably light cat naphtha, can be recracked in the presence of ZSM-5, high cat-to-oil ratios, and high riser outlet temperatures to produce olefins. For maximum olefin yields, a second riser can be installed that processes recycled naphtha and operates at a riser outlet temperature of approximately 590° C. to 650° C.

The combination of high temperature and high levels of ZSM-5 allow the gasoline-range light olefins and light paraffins to crack. The high riser outlet temperature and the high heat of reaction maximize the effectiveness of the catalyst.

At a lower cost than a second riser, naphtha can alternatively be recycled to the "lift zone" at the base of the riser and below the fresh feed nozzles. This location produces the highest temperature possible in a unit with only one riser. However, in this scenario gasoline cracking is less than with a separate riser due to reduced residence time and inefficient gas-solid contacting. As a result, olefin yields are slightly lower and selectivity is better for lift-zone naphtha cracking than for separate-riser naphtha cracking. However, the second riser gives more operating flexibility, especially when it is desirable to maximize the distillate and light olefins with minimum gasoline produced. Thus, the choice between a lift-zone and a second riser depends on the need for operating flexibility and capital availability.

A typical dual riser MAXOFIN FCC configuration is depicted in FIG. 1.

Figure 2:
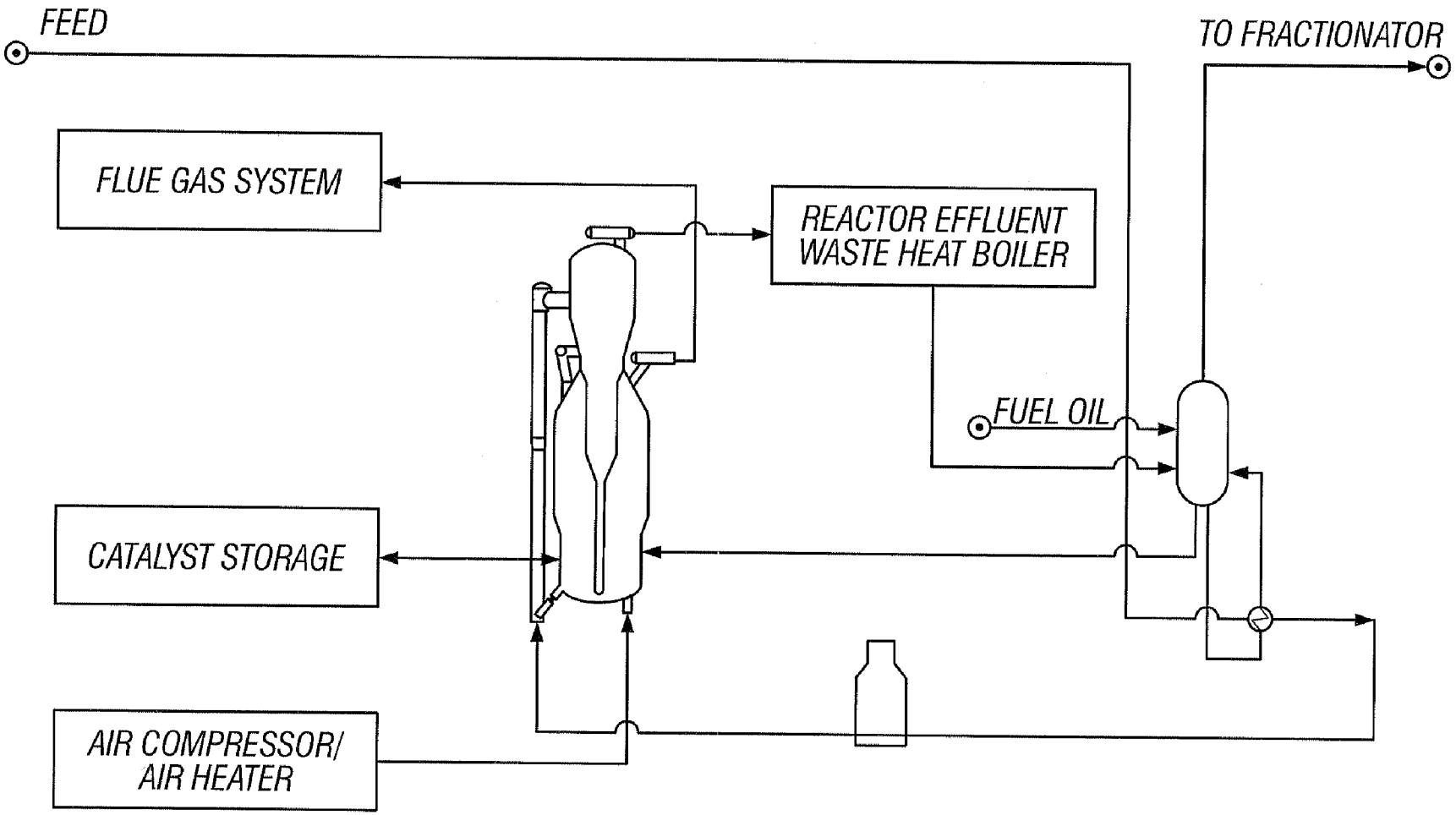
FIG. 2 is a schematic representation of a light hydrocarbon cracking reactor adapted for olefin production.

Another form of unconventional FCC technology useful in the processes described herein is a process that employs a fluidized catalytic reactor to convert light hydrocarbons, generally in the $C_4$ to $C_8$ range, to a higher value product stream rich in propylene. This FCC technology is available by license from Kellogg Brown & Root under the designation SUPERFLEX. A typical schematic for the SUPERFLEX catalytic cracking technology is depicted in FIG. 2. SUPERFLEX technology is a process that employs a fluidized catalytic reactor to convert light hydrocarbons, generally in the $C_4$ to $C_8$ range, to a higher value product stream rich in propylene. Streams with relatively high olefins content are the best feeds for the SUPERFLEX reactor. Thus, olefins plant by-product $C_4$ and $C_5$ cuts, either partially hydrogenated or as raffinate from an extraction process, are excellent feeds for this type of FCC unit. One of the benefits of the process is its ability to process other potentially low value olefins-rich streams, such as FCC and coker light naphthas from the refinery. These streams, in consideration of new motor gasoline regulations regarding vapor pressure, olefins content and oxygenate specifications, may have increasingly low value as blend stock for gasoline, but are good feeds for the SUPERFLEX reactor. In addition to propylene, the process also produces byproduct ethylene and a high octane gasoline fraction which adds more value to the overall operating margin.

The reactor (converter) is comprised of four sections: riser/reactor, disengager, stripper and regenerator. Associated systems for the reactor may be standard FCC systems and include air supply, flue gas handling and heat recovery. Reactor overheads are cooled and washed to recover entrained catalyst, which is recycled back to the reactor, as described in commonly assigned application U.S. Ser. No. 10/065,377, filed Oct. 10, 2002 by Michael Tallman, Robert B. Peterson, and Maureen F. Gilbert, for Catalyst Recovery from Light Olefin FCC Effluent, Publication No. 2004006984, now U.S. Pat. No. 7,011,740. The net overhead product is typically routed to the primary fractionator in the olefins plant, although, depending on the available capacity in a given plant, the reactor effluent could alternately be further cooled and routed to an olefins plant cracked gas compressor, or processed for product recovery in some other conventional manner.

Figure 3:
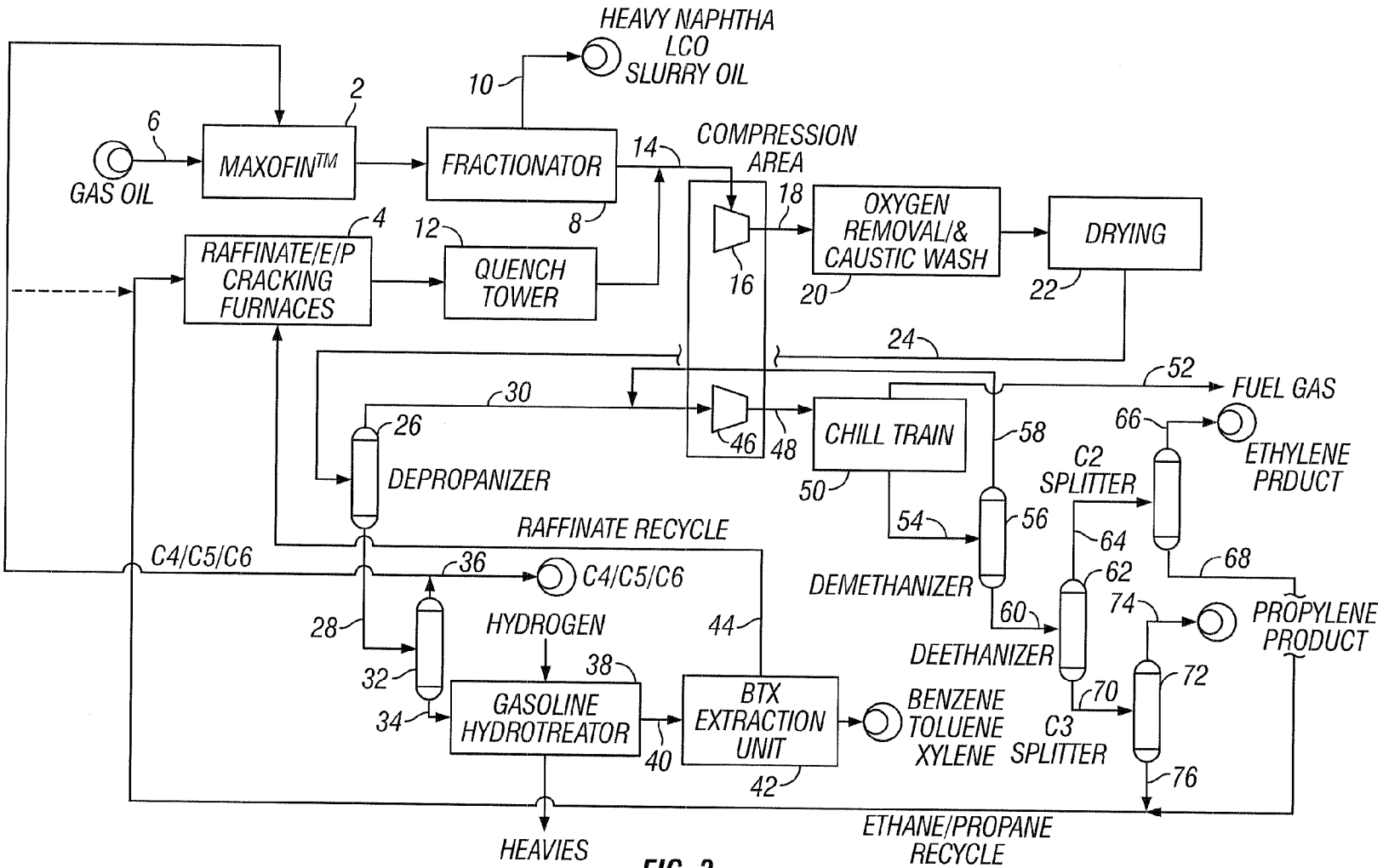
FIG. 3 is a block process flow diagram for an embodiment of the present invention incorporating an integrated steam pyrolysis reactor and a dual-riser FCC reactor.

FIG. 3 is a general process flow for an embodiment of the processes described herein. The embodiment depicted is one incorporating a MAXOFIN dual-riser catalytic cracker 2 as described above (see FIG. 1) and a thermal furnace cracker 4. The fresh feedstream in this embodiment is a gas oil stream 6 that is fed to the gas oil catalytic cracking zone or riser in the FCC unit 2. The second zone or riser in the FCC unit 2 is supplied with a feed stream comprising $C_4$, $C_5$, and/or $C_6$ olefins, for example a recycle of effluent stream 36 from the gasoline splitter 32 as described below. The effluent from the catalytic cracking unit 2 is comprised of methane, ethylene, propylene, butylene, cracked gas, and heavier components.

At the same time that the fresh feedstream is fed to one of the risers in the catalytic cracking unit 2, a hydrocarbon recycle stream is fed to the pyrolysis furnace cracking zone 4. The recycle stream is comprised primarily of ethane and/or propane. The effluent from the catalytic cracking unit 2 is fed to a fractionator 8 for separation of heavy naphtha, light cycle oil, and/or slurry oil in stream(s) 10. The effluent from the pyrolytic cracking zone 4 is cooled in quench tower or cooler 12 and then combined with the effluent from fractionator 8 to form stream 14.

Stream 14 is pressurized in compressor 16 to a pressure of from about 100 kPa to about 3000 kPa, depending on the separation scheme, preferably from 100 kPa to 1000 kPa for a depropanizer-first scheme. The pressurized stream 18 is conventionally subjected to treatment as necessary in unit 20 to remove oxygenates, acid gases and any other impurities from the cracked gas stream, followed by conventional drying in dryer 22. Although the order of fractionation can vary, the dried stream 24 is typically fed to depropanizer 26 where the stream is fractionated into a heavier stream 28 containing $C_4$ and gasoline components and a lighter stream 30 containing $C_3$ and lighter components. The heavier stream 28 can be routed to a gasoline splitter 32 where the stream is separated into a gasoline component stream 34 and a $C_4$, $C_5$ and/or $C_6$ effluent stream 36, which is recycled to the second riser in the catalytic cracker 2 and/or to the pyrolytic cracker 4, depending on desired product balances. The gasoline component stream 34 is typically fed to a gasoline hydrotreater 38 for stabilization.

In the embodiment depicted, the treated gasoline stream 40, containing $C_6$ and heavier hydrocarbons, is preferably fed to a BTX unit 42 for recovery of benzene, toluene, and/or xylene components. Any conventional BTX recovery unit is suitable. Exemplary BTX process units are described in U.S. Pat. No. 6,004,452. In the embodiment depicted in FIG. 3, the raffinate recycle stream 44 is fed to the thermal cracker 4. Alternatively, stream 44 is recycled to the MAXOFIN catalytic cracker 2, e.g. the light olefin cracking zone or riser, or it can be a product of the process.

The lighter stream 30 from the depropanizer is compressed in compressor 46 to a pressure of from about 500 kPa to about 1500 kPa to form pressurized stream 48 which is routed to a cryogenic chill train 50. A light stream 52 is removed from the chill train as a fuel gas, a product exported from the process, and/or for further processing such as hydrogen recovery or the like. The heavier stream 54 from the chill train is fed to a series of separators for isolation of olefin streams. Specifically, the stream 54 is typically fed to a demethanizer 56, which produces a light recycle stream 58 and a heavier product stream 60. The light recycle stream 58 can alternatively in whole or in part be a product of the process. The heavier product stream 60 is routed to a deethanizer 62 where it is separated into a light component stream 64 containing ethylene and a heavier stream containing $C_3$ and heavier components. Stream 64 is separated into an ethylene product stream 66 and an ethane stream 68 that is recycled to pyrolytic cracker 4. The heavier stream 70 from the deethanizer 62 is routed to a $C_3$ splitter 72 where it is split into a propylene product stream 74 and propane stream 76 that is recycled to thermal cracker 4. Alternatively, either or both of streams 68, 76, in whole or in part, can be a product of the process.

Integration of the catalytic and pyrolytic cracking units allows for flexibility in processing a variety of feedstocks. The integration allows thermal and catalytic cracking units to be used in a complementary fashion in a new or retrofitted petrochemical complex. The petrochemical complex can be designed to use the lowest value feedstreams available. Integration allows for production of an overall product slate with maximum value through routing of various by-products to the appropriate cracking technology. For example, if it is desired to process a light feedstream such as LPG or naphtha, in addition to the gas oil feedstream, the light feedstream is generally fed directly to the pyrolytic cracking unit. Moreover, the process described herein allows multiple fresh feedstreams to be processed simultaneously. For example, a fresh feedstream may be fed to one of the risers in the catalytic cracking unit while the recycle feedstream to the pyrolytic cracking unit may be supplemented with another relatively light fresh feedstream.

With the ability to integrate and utilize both thermal and dual-riser catalytic cracking units, it is also possible to alter the product mix yield from a given feedstream to produce a mix most desirable in prevailing market conditions. For example, selectivity of olefin production is enhanced. The pyrolytic cracking unit favors production of ethylene and propylene. In contrast, the catalytic cracking unit favors propylene and higher olefins production, and also co-produces ethylene. Therefore, when market conditions favor enhanced propylene production, the $C_4/C_5/C_6$ effluent stream 36 depicted in FIG. 3 may be directed to the second riser in catalytic cracker 2. When market conditions favor enhanced ethylene production, the $C_4/C_5/C_6$ effluent stream 36 and ethane/propane recycle stream 68 depicted in FIG. 1 may be directed to the pyrolytic cracker 4. Recycling stream 36 is desirable for enhanced olefin production, but if desired a portion of stream 36 can also be produced as a process export.

Figure 4:
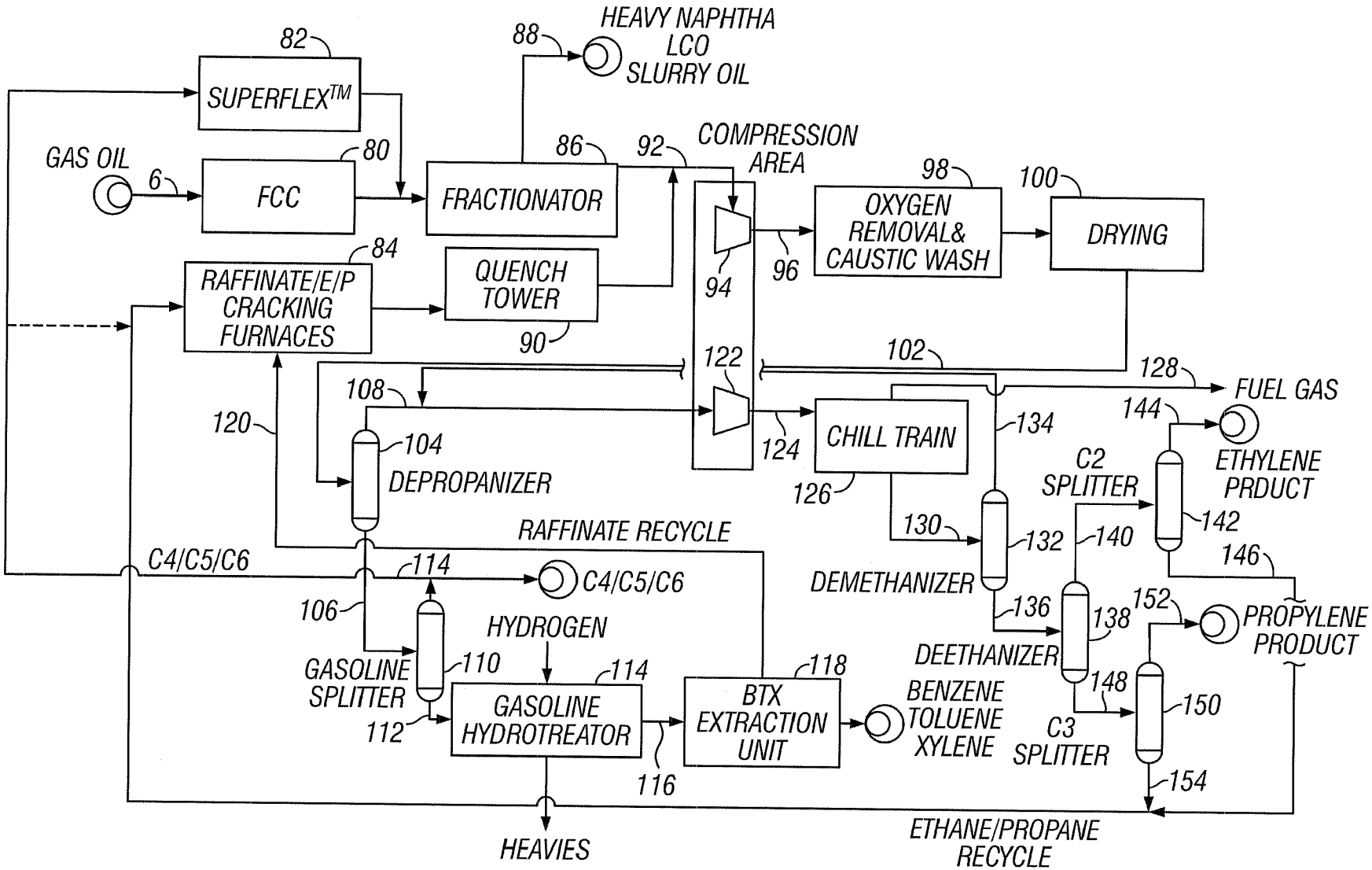
FIG. 4 is a block process flow diagram for an embodiment of the present invention incorporating an integrated steam pyrolysis reactor, a waxy gas oil FCC reactor, and a light hydrocarbon FCC reactor.

Another embodiment of the process described herein is depicted in FIG. 4. This embodiment makes use of two discrete catalytic crackers and one thermal cracker. In this embodiment, the catalytic crackers are a conventional gas oil-resid FCC cracker 80 and a SUPERFLEX cracker 82 as described above. The pyrolytic cracker is a conventional thermal cracking furnace 84. The fresh feedstream in this embodiment is a gas oil resid stream 6 that is fed to catalytic cracking zone 80. In the catalytic cracking zone 80, the feedstream is cracked as described above. The effluent from the FCC cracking zone 80 is comprised of methane, ethylene, propylene, butylene, cracked gas and heavier components.

At the same time that the fresh feedstream is fed to the FCC cracking zone 80, hydrocarbon recycle streams are fed to the SUPERFLEX catalytic cracker 82 and pyrolysis furnace cracking zone 84. The recycle stream to the SUPERFLEX cracker 82 is comprised primarily of $C_4$, $C_5$ and/or $C_6$ components. The recycle stream to the pyrolytic cracker 84 is comprised primarily of ethane and/or propane. The effluent from the FCC cracking zone 80 is combined with the effluent from the SUPERFLEX cracking zone 82 and the combined stream is fed to a fractionator 86 for separation of heavy naphtha, light cycle oil, and slurry oil in stream(s) 88. The effluent from the pyrolytic cracking zone 84 is cooled in quench or cooling tower 90 and then combined with the effluent from fractionator 86 to form stream 92.

Stream 92 is pressurized in compressor 94 to a pressure of from about 100 kPa to about 3000 kPa, depending on the separation scheme, preferably from 100 kPa to 1000 kPa for a depropanizer-first scheme. The pressurized stream 96 is then subjected to treatment as necessary in unit 98 to remove oxygenates, acid gases, and any other impurities, followed by drying in dryer 100. Although other separation schemes can be employed, the dried stream 102 is typically fed to depropanizer 104 where the stream is fractionated into a heavier stream 106 containing gasoline components and a lighter stream 108 containing light olefin components. The heavier stream 106 is generally routed to a gasoline splitter 110 where the stream is separated into a gasoline component stream 112 and a $C_4$, $C_5$ and/or $C_6$ stream 114, which is recycled to the pyrolytic cracker 84 or the catalytic cracker 82, depending on desired product balances. The gasoline component stream 112 is fed to a gasoline hydrotreater 114 for stabilization.

In the embodiment depicted, the treated gasoline stream 116 is fed to a conventional BTX unit 118 for recovery of benzene, toluene, and/or xylene components as previously described for FIG. 3. In this embodiment, the raffinate recycle stream 120 is fed to the pyrolytic cracker 84, or it could be fed to the SUPERFLEX catalytic cracker 82. Alternatively, the raffinate stream 120 can be a product of the process.

The lighter stream 108 from the depropanizer 104 is compressed in compressor 122 to a pressure of from about 500 kPa to about 1500 kPa to form pressurized stream 124 which is routed to a cryogenic chill train 126. A light stream 128 is removed from the chill train as a fuel gas. The heavier stream 130 from the chill train is fed to a series of separators for isolation of olefin streams. Specifically, the stream 130 is fed to a demethanizer 132 which produces a light recycle stream 134 and a heavier product stream 136, which is routed to a deethanizer 138. The deethanizer 138 separates the stream into a light component stream 140 containing ethylene. Stream 140 is fed to a $C_2$ splitter 142 where it is separated into an ethylene product stream 144 and an ethane stream 146 that is recycled to thermal cracker 84. The heavier stream 148 from the deethanizer 138 is routed to a $C_3$ splitter 150 where the stream 148 is split into a propylene product stream 152 and a propane stream 154 that is recycled to pyrolytic cracker 84. Alternatively, either or both of streams 146, 154, in whole or in part, can be a product of the process.

Integration of the catalytic and pyrolytic cracking units allows for flexibility in processing a variety of feedstocks. The integration allows pyrolytic and catalytic cracking units to be used in a complementary fashion in a new or retrofitted petrochemical complex. The petrochemical complex can be designed to use the lowest value feedstreams available. Integration allows for production of an overall product slate with maximum value through routing of various by-products to the appropriate cracking technology. For example, if it is desired to process a light feedstream such as LPG or naphtha, the feedstream may be processed by feeding it directly to the pyrolytic cracking unit. Moreover, the process described herein allows multiple fresh feedstreams to be processed simultaneously. For example, a fresh feedstream may be fed to the catalytic cracking unit while the recycle feedstream to the pyrolytic cracking unit may be supplemented with a relatively light fresh feedstream.

With the ability to integrate and utilize both pyrolytic and catalytic cracking units, it is also possible to alter the product mix yield from a given feedstream to produce a mix most desirable in prevailing market conditions. For example, selectively of olefin production is enhanced. The thermal cracking unit favors production of ethylene and propylene. In contrast, the catalytic cracking unit favors propylene and higher olefins production. Therefore, when market conditions favor enhanced propylene production, the $C_4/C_5/C_6$ effluent stream 36 and the BTX raffinate recycle stream 120 depicted in FIG. 4 may be directed to the catalytic cracker 82. When market conditions favor enhanced ethylene production, the $C_4/C_5/C_6$ effluent stream 114, BTX raffinate stream 120 and/or ethane/propane recycle stream 154 can be directed to the thermal cracker 84.

Table 1 compares the simulated overall material balances for various cracking unit configurations in accordance with the present invention (Runs 1–6) with those for prior art configurations having only single or dual FCC zones (Base 1 and 2, respectively). Runs 1 and 5 represent the embodiment depicted in FIG. 3, i.e. a dual-riser MAXOFIN unit with a pyrolytic reactor. Runs 2–4 and 6 are for the FIG. 4 embodiment, i.e. a conventional gas oil FCC cracker, a SUPERFLEX catalytic cracker and a pyrolysis unit.

TABLE 1

Overall Material Balances For Various Configurations.

| Run | Base 1 | Base 2 | 1 | 2 | 3 | 4 | 5 | 6 |
|---|---|---|---|---|---|---|---|---|
| Configuration | FCC Only | Two FCC's | FIG. 3 | FIG. 4 | FIG. 4 | FIG. 4 | FIG. 3 | FIG. 4 |
| Feed | LSWR | LSWR | LSWR | LSWR | LSFO | Cabinda | Petronas | Petronas |
| Cracking reactors: | | | | | | | | |
| Gas Oil FCC | Yes | Yes | No | Yes | Yes | Yes | No | Yes |
| SUPERFLEX | No | Yes | No | Yes | Yes | Yes | No | Yes |
| MAXOFIN | No | No | Yes | No | No | No | Yes | No |
| Pyrolysis | No | No | Yes | Yes | Yes | Yes | Yes | Yes |
| Product | Product Yield, Weight Percent | | | | | | | |
| Ethylene | 4.7 | 9.4 | 13.6 | 16.9 | 16.0 | 16.2 | 14.2 | 18.9 |
| Propylene | 11.5 | 21.9 | 20.1 | 25.6 | 24.0 | 24.9 | 24.8 | 32.9 |
| Benzene | 0.00 | 1.3 | 1.6 | 2.0 | 2.0 | 2.0 | 1.6 | 2.1 |
| Toluene | 0.00 | 4.2 | 4.5 | 4.7 | 5.2 | 4.7 | 4.4 | 4.8 |
| Xyl + EB | 0.00 | 6.5 | 6.6 | 6.8 | 7.8 | 6.9 | 6.4 | 6.9 |
| Tail Gas | 3.0 | 4.7 | 6.9 | 8.1 | 8.4 | 7.9 | 5.6 | 8.0 |
| C4–C6 | 20.3 | 0.0 | 18.2 | 0.0 | 0.0 | 0.0 | 23.6 | 0.0 |
| Light Naphtha | 20.7 | | | | | | | |
| Heavy Naphtha | 13.5 | 13.8 | 11.8 | 13.9 | 8.5 | 10.4 | 7.6 | 10.7 |
| LCO | 6.3 | 6.3 | 4.9 | 6.3 | 8.5 | 8.3 | 2.8 | 4.0 |
| Slurry Oil | 5.5 | 5.5 | 4.4 | 5.6 | 7.0 | 7.0 | 2.3 | 3.2 |
| Coke | 9.4 | 9.4 | 7.4 | 10.1 | 12.7 | 11.4 | 6.5 | 8.5 |
| Ethane | 1.1 | 2.1 | 0.0 | 0.0 | 0.0 | 0.0 | 0.0 | 0.0 |
| Propane | 3.8 | 5.0 | 0.0 | 0.0 | 0.0 | 0.0 | 0.0 | 0.0 |
| BTX Raffinate | 0.0 | 9.9 | 0.0 | 0.0 | 0.0 | 0.0 | 0.0 | 0.0 |
| TOTAL | 100.0 | 100.0 | 100.0 | 100.0 | 100.00 | 100.00 | 100.00 | 100.00 |

LSWR = Low Sulfur Waxy Residue
LSFO = Low Sulfur Fuel Oil
Cabinda = Low Sulfur West African Crude
Petronas = Malaysian Crude These data show that the present invention can improve ethylene and/or propylene yield relative to the prior art single or dual FCC cracking zones.

The integration of cracking units described herein allows petrochemical plants to be operated using low value feedstreams by enhancing production yield of high valve products. The integration of cracking reactors as described herein may be adopted in grass roots plants as well as for retrofitting existing plants. The integration of cracking units described herein may be used in an arrangement for integrating cracking operations and petrochemical derivative processing operations as described in U.S. Pat. No. 5,981,818.

All patents and publications referred to herein are hereby incorporated by reference in their entireties.

Although the various embodiments and their advantages have been described in detail, it should be understood that various changes, substitutions, and alterations could be made without departing from the spirit and scope of the invention as defined by the following claims.

The invention claimed is:

1. An olefin process, comprising:

passing a light alkane stream comprising ethane, propane or a combination thereof through a steam pyrolysis zone and quenching effluent therefrom to form a pyrolysis effluent enriched in ethylene, propylene or a combination thereof;

cracking a light hydrocarbon stream comprising olefins having at least 4 carbon atoms in a first FCC zone to form a first FCC effluent enriched in ethylene, propylene or a combination thereof;

cracking a refinery stream comprising gas oil, full range gas oil, resid, or a combination thereof, in a second FCC zone to form a second FCC effluent enriched in ethylene, propylene or a combination thereof;

fractionating the first and second FCC effluents together to remove heavy naphtha, light cycle oil, slurry oil, or a combination thereof and recover a combined olefin-containing FCC fraction;

conditioning the pyrolysis effluent together with the combined FCC fraction to remove oxygenates, acid gases, water or a combination thereof to form a conditoned stream;

separating the conditioned stream into at least a tail gas stream, an ethylene product stream, a propylene product stream, a light stream comprising ethane, propane, or a combination thereof, an intermediate stream comprising olefin selected from $C_4$ to $C_6$ olefins and mixtures thereof, and a heavy stream comprising $C_6$ and higher hydrocarbons;

recycling the light stream to the steam pyrolysis zone; and recycling the intermediate stream to the first FCC zone.

2. The olefin process of claim 1, further comprising recycling the heavy stream to the first FCC zone.

3. The olefin process of claim 1, further comprising:

hydrotreating the heavy stream to obtain a hydrotreated stream;

extracting a product stream comprising benzene, toluene, xylenes or a mixture thereof from the hydrotreated stream to obtain a raffinate stream lean in aromatics; and recycling the raffinate stream to the steam pyrolysis zone.

4. The olefin process of claim 1, wherein the light alkane stream passed through the steam pyrolysis zone further comprises naphtha.

5. The olefin process of claim 1, wherein the light alkane stream passed through the steam pyrolysis zone further comprises LPG.

6. The olefin process of claim 1, wherein the light hydrocarbon stream cracked in the first FCC zone comprises FCC naphtha.

7. The olefin process of claim 1, wherein the light hydrocarbon stream cracked in the first FCC zone comprises olefins having from 4 to 8 carbon atoms.

8. The olefin process of claim 1, wherein the refinery stream cracked in the second FCC zone comprises waxy gas oil.

9. An olefin process unit, comprising:

parallel steam pyrolysis, light olefin FCC and gas oil-resid FCC zones for producing a combined effluent comprising ethylene and propylene, comprising:

means for passing a light alkane stream comprising ethane, propane or a combination thereof through the steam pyrolysis zone and quenching effluent therefrom to form a pyrolysis effluent enriched in ethylene, propylene or a combination thereof;

means for cracking a light hydrocarbon stream comprising olefins having at least 4 carbon atoms in the light olefin FCC zone to form a first FCC effluent enriched in ethylene, propylene or a combination thereof;

means for cracking a refinery stream comprising gas oil, full range gas oil, resid, or a combination thereof, in a gas-oil resid FCC zone to form a second FCC effluent enriched in ethylene, propylene or a combination thereof;

means for fractionating the first and second FCC effluents together to remove heavy naphtha, light cycle oil, slurry oil, or a combination thereof and recover a combined olefin-containing FCC fraction;

means for conditioning the combined effluent comprising the pyrolysis effluent and the combined olefin-containing FCC fraction to remove oxygenates, acid gases and water to form a conditioned stream;

means for separating the conditioned stream into at least a tail gas stream, an ethylene product stream, a propylene product stream, a light stream comprising ethane, propane, or a combination thereof, an intermediate stream comprising olefin selected from $C_4$ to $C_6$ olefins and mixtures thereof, and a heavy stream comprising $C_6$ and higher hydrocarbons;

means for recycling the light stream to the steam pyrolysis zone; and means for recycling the intermediate stream to the first FCC zone.

* * * * *